US008951074B2

(12) United States Patent
Severac

(10) Patent No.: US 8,951,074 B2
(45) Date of Patent: Feb. 10, 2015

(54) SOCKET, A PLUG, AND AN ASSEMBLY

(75) Inventor: Didier Severac, Techpoint (SG)

(73) Assignee: Schneider Electric Industries SAS, Rueil Malmaison (FR)

( * ) Notice: Subject to any disclaimer, the term of this patent is extended or adjusted under 35 U.S.C. 154(b) by 25 days.

(21) Appl. No.: 13/472,450

(22) Filed: May 15, 2012

(65) Prior Publication Data

US 2012/0295456 A1 Nov. 22, 2012

(30) Foreign Application Priority Data

May 16, 2011 (SG) ..... 201103584-7

(51) Int. Cl.

| | |
|---|---|
| ***H01R 13/64*** | (2006.01) |
| ***H01R 27/00*** | (2006.01) |
| ***H01R 9/24*** | (2006.01) |
| ***H01R 13/645*** | (2006.01) |
| ***H01R 29/00*** | (2006.01) |

(52) U.S. Cl.

CPC ..... *H01R 27/00* (2013.01); *H01R 9/2408* (2013.01); *H01R 13/6456* (2013.01); *H01R 29/00* (2013.01); *Y10S 439/956* (2013.01)

USPC ..... 439/681; 439/956

(58) Field of Classification Search

USPC ..... 439/681, 956

See application file for complete search history.

(56) References Cited

U.S. PATENT DOCUMENTS

| | | | | |
|---|---|---|---|---|
| 3,034,000 | A | 5/1962 | Todd | |
| 3,509,856 | A * | 5/1970 | Muller et al. | 122/6 R |
| 4,386,333 | A * | 5/1983 | Dillan | 336/107 |
| 4,649,332 | A * | 3/1987 | Bell | 320/117 |
| 5,639,251 | A | 6/1997 | Harting et al. | |
| 5,860,822 | A | 1/1999 | Nishide et al. | |
| 6,410,868 | B1 | 6/2002 | Berlemont et al. | |
| 6,974,342 | B2 * | 12/2005 | Thomas | 439/222 |
| 2004/0157499 | A1 | 8/2004 | Nania et al. | |
| 2005/0245116 | A1 | 11/2005 | Thomas | |
| 2006/0063438 | A1 | 3/2006 | Dent | |

FOREIGN PATENT DOCUMENTS

| | | | |
|---|---|---|---|
| EP | 2221929 | A1 | 8/2010 |
| FR | 2899728 | A1 | 10/2007 |
| GB | 925501 | | 5/1963 |
| GB | 2296390 | A | 6/1996 |
| WO | 9610280 | | 4/1996 |

OTHER PUBLICATIONS

European Search Report, issued by European Patent Office on Jun. 25, 2014, in counterpart European Application No. 12168007.8.

Office Action issued Feb. 8, 2014 by Chinese Patent Office in counterpart Chinese Patent Application No. 201210151990.X (with an English language translation of the Office Action).

Written Opinion and Search Report issued by the Hungarian Intellectual Property Office (HIPO) on Oct. 11, 2013, for priority Singapore patent application No. 201103584-7.

* cited by examiner

*Primary Examiner* — Phuong Dinh

(74) *Attorney, Agent, or Firm* — Frommer Lawrence & Haug LLP; David V. Rossi

(57) ABSTRACT

A plug and socket assembly comprising (i) a socket that includes a mating means disposed thereon, and an electrical contact on the socket, and (ii) a plug that includes a matching means for mating with the mating means disposed on the socket, and a conducting terminal for coupling electrically to the electrical contact on the socket. The matching means is configured to be adjustable between a compatible mode and an incompatible mode. When in the compatible mode, the matching means allows the electrical contact to contact the conducting terminal, and when in the incompatible mode, the matching means substantially prevents the electrical contact from contacting the conducting terminal.

23 Claims, 12 Drawing Sheets

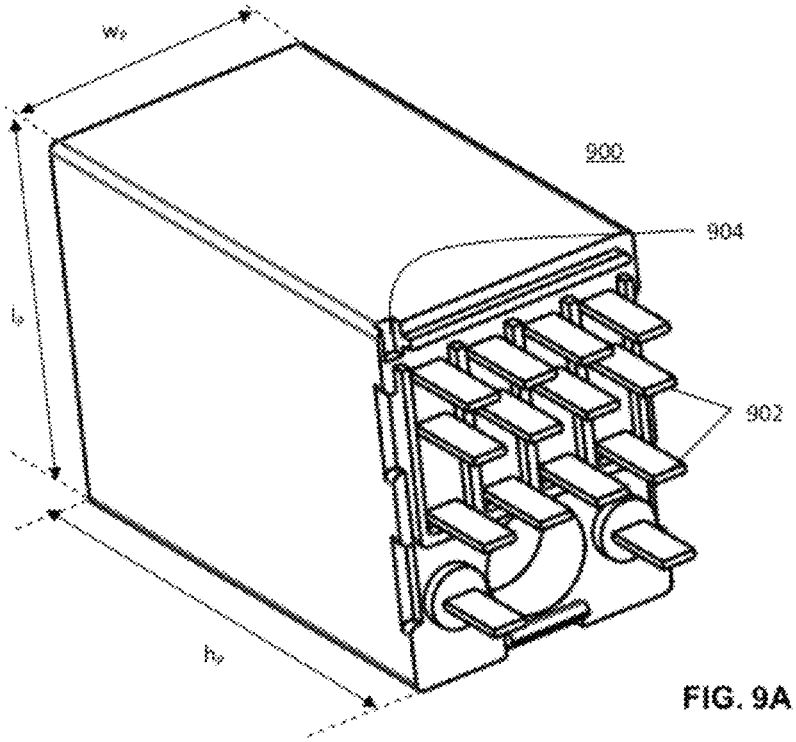
FIG. 9A
FIG. 9B
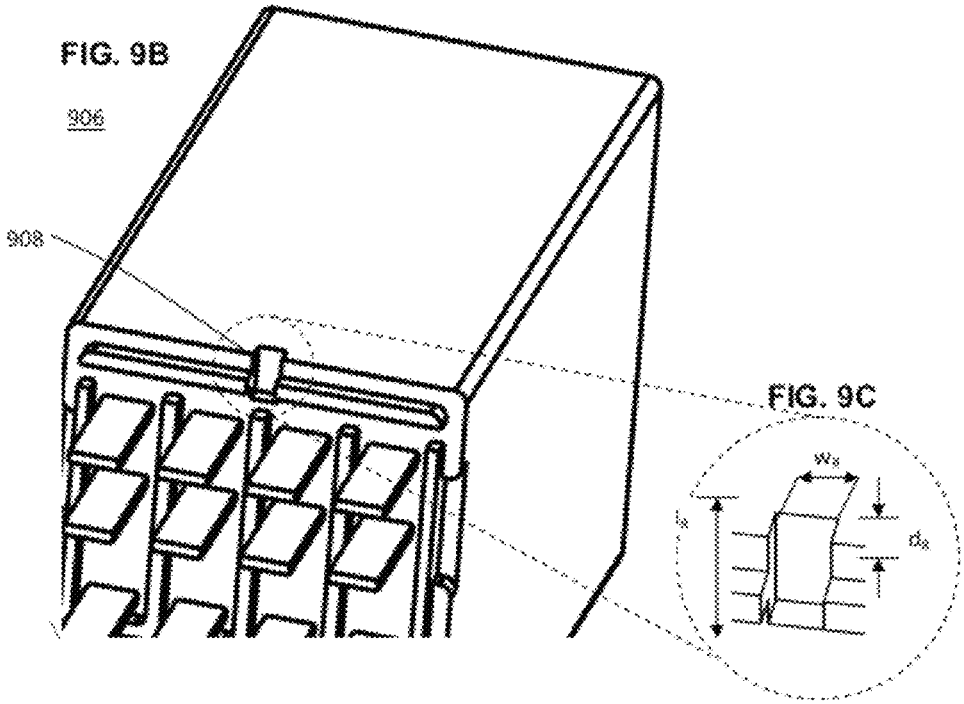

SOCKET, A PLUG, AND AN ASSEMBLY

RELATED APPLICATIONS

This application is based upon and claims the benefit of priority from the corresponding Singapore Patent Application No. 201103584-7, filed May 16, 2011, which is incorporated herein by reference in its entirety.

TECHNICAL FIELD

The present disclosure broadly relates to a socket, a plug, and a plug and socket assembly. The present disclosure also relates to a relay plug and relay socket assembly for use in an electrical system.

BACKGROUND

Plugs and sockets are typically used in an electrical system for providing electrical connectivity between devices. Connecting an incompatible plug to an incorrect socket may lead to adverse consequences such as circuit malfunction or overloading.

For example, in an electrical system involving the use of a plug-in relay between a controlling circuit and a controlled circuit, it is important that the relay is of an appropriate voltage rating configuration for use in a set-up of the controlling circuit and the controlled circuit. If an inappropriate relay were to be used, this may lead to the misoperation of the relay and/or, eventually, to the failure of the circuits in the electrical system.

To enable a compatible plug to couple to its complimentary socket, attempts have been made to ensure that the compatible plug is coupled to the correct socket. Such attempts include visual indications such as labeling (for example, a plug labeled "A" for a socket labeled "A", a plug labeled "220V" for a socket labeled "220V", etc.); and color coding (for example, a plug with a red plug housing for a socket with a red socket housing, a plug with a blue plug housing for a socket with a blue socket housing, etc.).

Currently available relays or plug-in relays have indications of voltage rating configurations printed on their housings, or have colored (usually red for AC configurations or green for DC configurations) pushbuttons installed thereon for visual indications on the different types of plug-in relays. However, no corresponding indications of the voltage rating configurations are provided on the relay sockets receiving these relays. A relay socket, unlike a relay or a plug-in relay, typically does not carry any permanent indications of its voltage rating configuration because the relay socket is used for connecting to different set-ups for the controlling circuit and/or the controlled circuit and would therefore be subject to a voltage rating configuration that is dependent on each set-up.

As a result of the absence of any indication on the relay socket on the specific voltage rating configurations, it is difficult for users to easily, quickly and accurately identify the matching relay or plug-in relay for the specific socket. Consequently, a high possibility of relay plug and socket mismatch still exists.

Providing visual indications and colored pushbuttons for labelling the relay plugs to their specific voltage configuration are also not adequately effective in preventing or at substantially reducing the likelihood of a relay socket and plug-in relay mismatch since oversight still occurs frequently.

Therefore, there is a need to provide a socket, a plug, and a plug and socket assembly that overcome or at least ameliorate the disadvantages mentioned above.

There is also a need to provide a relay socket, a relay plug, and a relay plug and relay socket assembly that improve usability.

SUMMARY

According to a first aspect of some embodiments of the present invention, there is provided a socket for coupling electrically to a plug, the socket comprising a mating means disposed on the socket for mating with a matching means on the plug, said mating means configured to be adjustable between a compatible mode and an incompatible mode; and an electrical contact on the socket for coupling electrically to a conducting terminal of the plug, wherein when in the compatible mode, the mating means allows the electrical contact to contact the conducting terminal, and when in the incompatible mode, the mating means substantially prevents the electrical contact from contacting the conducting terminal. Advantageously, the socket is capable of easily and accurately ensuring that a correct plug can be fitted into the socket in the compatible mode and that an incorrect plug is substantially prevented from fitting into the socket in the incompatible mode. In one embodiment, when in use in the compatible mode, a voltage rating configuration of the socket matches or is compatible to a voltage rating configuration of the plug. Advantageously, this largely reduces the likelihood of circuit overloadings occurring due to an incompatible plug (in terms of voltage configuration) being fitted to the socket of a predetermined voltage configuration.

In one embodiment, the mating means and the electrical contact are disposed on a same surface of the socket. Advantageously, in some implementations, this enhances manufacturing ease and facilitates the installation of the socket to an electrical system, for example, under space-restricted conditions.

In one embodiment, the mating means comprises an abutment, and the matching means comprises a recess. Advantageously, when the matching means comprises a recess, the plug comprising the matching means can be universally used for other sockets known in the art without requiring further physical or mechanical alteration.

In another embodiment, the mating means comprises a recess, and the matching means comprises an abutment. Advantageously, when the mating means comprises a recess, the socket comprising the mating means can be universally used for other sockets known in the art without requiring further physical or mechanical alteration.

The abutment disclosed herein may be electrically non-conductive. This may be beneficial in reducing manufacturing costs, in increasing aesthetic appeal and/or, to some extent, for electrical safety purposes. In one embodiment, the abutment is made of a plastic or rubber material. Advantageously, such component can be easily manufactured. The abutment may positionally slidable between the compatible mode and the incompatible mode. In one embodiment, the abutment is slidable on a guide disposed on the surface of the socket. Accordingly, the user is provided with relative ease when switching between different modes.

The abutment may also be reversibly securable at predetermined positions so that there may be a reduced possibility that the abutment will not shift to different positions inadvertently, more specifically, during the fitting of the plug to the socket. As the abutment may be reversibly securable, the abutment will still be allowed to be unsecured and moved to a different position when desired. Accordingly, the guide may comprise a retaining means for reversibly securing the abutment at at least one of the predetermined positions. In one embodiment, the abutment comprises a flange portion; and wherein the retaining means comprises a slot for releasably engaging the flange portion of the abutment at the at least one of the predetermined positions.

In the embodiment when the mating means comprises a recess, and the matching means comprises an abutment, the mating means may be reversibly sealable to be positionable in the compatible mode or in the incompatible mode. The recess may be partially sealed such that the position of the opening to the recess is altered.

The socket may further comprise plural electrical contacts on the socket for electrically coupling to plural conducting terminals of the plug to establish electrical connections therebetween when in the compatible mode. This may allow a full electrical connection to be established between the socket and the plug.

In one embodiment, the socket is a relay socket. The plug may be a relay plug.

In one embodiment, the incompatible mode comprises at least two different predetermined positions at which the mating means is positionable. This allows at least three different voltage configurations to correspond to each different position, i.e. one voltage configuration for the predetermined position for the compatible mode and the other at least two voltage configurations for the predetermined positions in the incompatible mode.

In one embodiment, the mating means is disposed on a socket housing of the socket.

The socket may further comprise an indicating means for visually indicating to a user the different predetermined positions at which the mating means is positionable. Advantageously, the user is able to clearly identify the different predetermined positions.

According to a second aspect of some embodiments of the present invention, there is provided a plug for coupling electrically to a socket disclosed herein, the plug comprising a matching means on the plug for mating with the mating means disposed on the socket, said mating means configured to be adjustable between the compatible mode and the incompatible mode; and a conducting terminal for coupling electrically to the electrical contact on the socket, wherein when in the compatible mode, the matching means allows the electrical contact to contact the conducting terminal, and when in the incompatible mode, the matching means substantially prevents the electrical contact from contacting the conducting terminal.

According to a third aspect of some embodiments of the present invention, there is provided a socket housing for a socket disclosed herein.

According to a fourth aspect of some embodiments of the present invention, there is provided a plug and socket assembly comprising a socket comprising a mating means disposed thereon, said mating means configured to be adjustable between a compatible mode and an incompatible mode; and an electrical contact on the socket; and a plug comprising a matching means for mating with the mating means disposed on the socket; and a conducting terminal for coupling electrically to the electrical contact on the socket, wherein when in the compatible mode, the mating means allows the electrical contact to contact the conducting terminal, and when in the incompatible mode, the mating means substantially prevents the electrical contact from contacting the conducting terminal.

According to a fifth aspect of some embodiments of the present invention, there is provided a plug and socket assembly comprising a socket comprising a mating means disposed thereon; and an electrical contact on the socket, and a plug comprising a matching means for mating with the mating means disposed on the socket, said matching means configured to be adjustable between a compatible mode and an incompatible mode; and a conducting terminal for coupling electrically to the electrical contact on the socket, wherein when in the compatible mode, the matching means allows the electrical contact to contact the conducting terminal, and when in the incompatible mode, the matching means substantially prevents the electrical contact from contacting the conducting terminal.

According to a sixth aspect of some embodiments of the present invention, there is provided a plug and socket assembly comprising a socket disclosed herein; and/or a plug disclosed herein for coupling electrically to the socket.

The plug and socket assembly disclosed herein may be a relay plug and relay socket assembly.

Throughout the specification and claims, the following terms take at least the meanings explicitly associated herein, unless the context dictates otherwise. The meanings identified below do not necessarily limit the terms, but merely provide illustrative examples for the terms. The phrase "an embodiment" or "one embodiment" as used herein does not necessarily refer to the same embodiment, though it may. In addition, the meaning of "a," "an," and "the" include plural references; thus, for example, "an embodiment" is not limited to a single embodiment but may refer to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

The term "relay" as used herein broadly refers to an electrically operated switch that is positioned within an electric circuit, and has an open state to interrupt current from flowing through the circuit, and a closed state to allow current to flow through the circuit.

The terms "relay socket", "relay plug", and "relay plug and relay socket assembly" are to be construed accordingly. The term "relay plug" may be used interchangeably with the term "plug-in relay" disclosed herein.

The term "coupled" as used herein is intended to cover both directly connected or connected through one or more intermediate means.

It will be appreciated by those skilled in the art that the foregoing brief description and the following detailed description are exemplary (i.e., illustrative) and explanatory of the subject matter of the present disclosure, but are not intended to be restrictive thereof or limiting the advantages which can be achieved by the present disclosure in various implementations. Additionally, it is understood that the foregoing summary and ensuing detailed description are representative of some embodiments of the present disclosure, and are neither representative nor inclusive of all subject matter and embodiments within the scope of the present disclosure.

BRIEF DESCRIPTION OF THE DRAWINGS

Aspects, features, and advantages of some embodiments of the invention, both as to structure and operation, will be understood and will become more readily apparent when the invention is considered in the light of the following description made in conjunction with the accompanying drawings, in which like reference numerals designate the same or similar parts throughout the various figures, and wherein:

FIGS. 9A and 9B show perspective views of different embodiments of a relay disclosed herein;

FIG. 9C shows a magnified view of a portion of the view shown in FIG. 9B;

DETAILED DESCRIPTION

Figure 1:
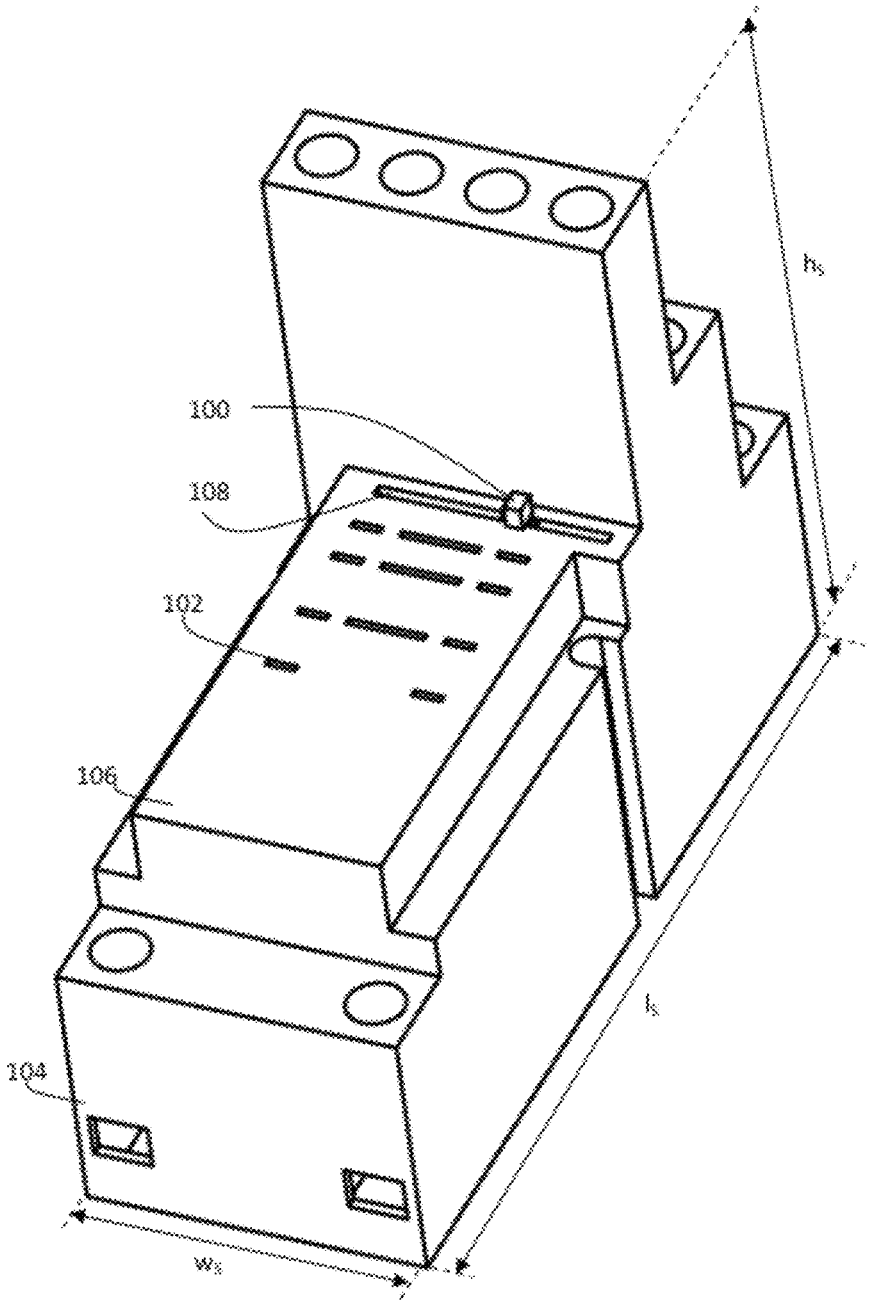
FIG. 1 shows a perspective view of an embodiment of a socket disclosed herein according to some embodiments.

Exemplary, non-limiting embodiments of a socket, plug, and socket and plug assembly will now be disclosed. More specifically, prior to describing various illustrative embodiments specifically with reference to the figures described above, the ensuing disclosure describes various illustrative embodiments without specific reference to the figures. Those skilled in the art, however, will understand relationships between embodiments disclosed with reference to the figures and embodiments disclosed without specific reference to the figures and will further understand variations of the latter embodiments in view of the former and vice versa.

In accordance with some embodiments, there is provided a socket for coupling electrically to a plug, the socket comprising a mating means disposed on the socket for mating with a matching means on the plug, said mating means configured to be adjustable between a compatible mode and an incompatible mode; and an electrical contact on the socket for coupling electrically to a conducting terminal of the plug, wherein when in the compatible mode, the mating means allows the electrical contact to contact the conducting terminal, and when in the incompatible mode, the mating means substantially prevents the electrical contact from contacting the conducting terminal. In the compatible mode, mating means is capable of mating with the matching means and the electrical contact is capable of contacting the conducting terminal concurrently. In the incompatible mode, the mating means may substantially prevent the electrical contact from contacting the conducting terminal by a mechanical or physical obstruction. The socket may be a relay socket and the plug may be a relay plug.

The mating means of the socket may be any physical feature that is capable of mating with the matching means of the plug when in the compatible mode whilst at the same time allowing the electrical contact to contact the conducting terminal. Likewise, the matching means of the plug may be any physical feature that is capable of mating with the mating means of the socket in the compatible mode whilst at the same time allowing the electrical contact to contact the conducting terminal. In one embodiment, the mating means is selected from the group consisting of a protrusion, projection, abutment, extension and the like, while the matching means is selected from the group consisting of a hole, slot depression, recess, opening, aperture and the like. In another embodiment, the matching means is selected from the group consisting of a protrusion, projection, abutment, extension and the like, while the mating means is selected from the group consisting of a hole, slot, depression, recess, opening, aperture and the like. Preferably, the mating means is an abutment while the matching means is a recess. In a different embodiment, the relay socket comprises a mating means, which is a recess or a plurality of recesses. Each of these recesses may be removably sealed as determined by a user. In certain embodiments, the mating means and/or the matching means may also be independently removable from the socket and plug respectively. When the mating means is removed from socket, the socket may be compatible with plugs known in the art. When the matching means is removed from the plug, the socket may be compatible with sockets known in the art. Accordingly, the socket and/or the plug may independently further comprise a removable stopper for preventing the mating means and/or the matching means from being removed from the socket and/or the plug inadvertently. The stopper may be made of a metal or a resilient material that is non-conductive or a combination thereof. Exemplary resilient material that is non-conductive includes polymers such as rubber and plastic.

In another embodiment, the mating means of the socket is adjustable to a mode which allows the socket to be compatible with plugs known in the art. In yet another embodiment, the matching means of the plug is adjustable to a mode which allows the plug to be compatible with sockets known in the art.

The mating means and/or the matching means may be made of a metal or a resilient material that is non-conductive or a combination thereof. Exemplary resilient material that is non-conductive includes polymers such as rubber and plastic.

In one embodiment, the compatible mode and the incompatible is representative of the compatibility and incompatibility respectively between the voltage configuration of the socket and that of the plug. The compatible mode and incompatible mode may be determined by at least one of the following: the spatial positions of the mating means and matching means, the dimensions of the mating means and matching means (for example height differences etc.), the shape of the mating means and matching means, the orientation of the mating means and matching means or the size of the mating means and matching means.

In one embodiment, the mating means and the electrical contact are disposed on a same surface of the socket. In another embodiment, the mating means and the electrical contact are disposed on different surfaces of the socket.

In the embodiment where the mating means or the matching means is an abutment, the abutment is positionally slidable between the compatible mode and the incompatible mode. The abutment may be slidable on a guide disposed on the surface of the socket. The abutment may reversibly securable at predetermined positions. The guide may comprise a retaining means for reversibly securing the abutment at at least one of the predetermined positions. The guide may be of a curved structure or any irregular structure suitable for the abutment to be positionally slidable between the compatible mode and the incompatible mode. The retaining means may comprise a latching mechanism. In one embodiment, the abutment comprises a flange portion; and the retaining means comprises a slot for releasably engaging the flange portion of the abutment at the at least one of the predetermined positions.

In the embodiment where the mating means is a recess, the mating means is reversibly sealable to be positionable in the compatible mode or in the incompatible mode.

In one embodiment, when in use in the compatible mode, a voltage rating configuration of the socket matches or is compatible to a voltage rating configuration of the plug. The incompatible mode may comprise one predetermined position, two, three, four, five, six, seven, eight, nine or ten different predetermined positions at which the mating means is positionable. Preferably, the incompatible mode may comprise seven different predetermined positions.

The disclosed socket may further comprising an indicating means for visually indicating to a user the different predetermined positions at which the mating means is positionable. In various embodiments, the indicating means may be in a form of engravings or embossings or markings or labels.

In one embodiment, the mating means is disposed on a socket housing of the socket. Accordingly, there is also provided a socket housing for a socket disclosed herein. The socket housing may also comprise access holes or openings for accessing the electrical contacts of the socket fitted therein. In another embodiment, where the mating means is not disposed on the socket housing, the socket housing comprises access holes or openings to allow the mating means of the socket to pass through said housing. The socket housing may generally be made of thermoplastic polymers such as polyurethane or Teflon. Thermosetting polymers may also be used to produce the socket housing.

In one embodiment the conducting terminal comprises a conducting pin.

In accordance with some embodiments, there is also provided a plug for coupling electrically to a socket disclosed herein, the plug comprising a matching means on the plug for mating with the mating means disposed on the socket; and a conducting terminal for coupling electrically to the electrical contact on the socket, wherein when in the compatible mode, the matching means allows the electrical contact to contact the conducting terminal, and when in the incompatible mode, the matching means substantially prevents the electrical contact from contacting the conducting terminal. The matching means of the plug may be as previously described above. In various embodiments, the conducting terminal of the plug extends from a surface of the plug and connects to a component housed within the plug.

In accordance with some embodiments, there is also provided a plug and socket assembly comprising a socket comprising a mating means disposed thereon, said mating means configured to be adjustable between a compatible mode and an incompatible mode; and an electrical contact on the socket; and a plug comprising a matching means for mating with the mating means disposed on the socket; and a conducting terminal for coupling electrically to the electrical contact on the socket, wherein when in the compatible mode, the mating means allows the electrical contact to contact the conducting terminal, and when in the incompatible mode, the mating means substantially prevents the electrical contact from contacting the conducting terminal. The plug and the socket of the assembly may also comprise one or more of the additional features previously described above.

In accordance with some embodiments, there is also provided a plug and socket assembly comprising a socket comprising a mating means disposed thereon; and an electrical contact on the socket, and a plug comprising a matching means for mating with the mating means disposed on the socket, said matching means configured to be adjustable between a compatible mode and an incompatible mode; and a conducting terminal for coupling electrically to the electrical contact on the socket, wherein when in the compatible mode, the matching means allows the electrical contact to contact the conducting terminal, and when in the incompatible mode, the matching means substantially prevents the electrical contact from contacting the conducting terminal. The plug and the socket of the assembly may also comprise one or more of the additional features previously described above.

In accordance with some embodiments, there is also provided a plug and socket assembly comprising at least one of a socket disclosed herein and a plug disclosed herein for coupling electrically to the socket.

The plug and socket assembly of disclosed herein may be a relay plug and relay socket assembly.

In some embodiments, the relay socket for receiving the relay plug may comprise screw clamp terminals or screw connectors for connection or wire connection to external circuitry. Such screw clamp terminals or screw connectors may be located at one end of the relay socket or at opposite ends of the relay socket. In the case where the relay socket comprises screw clamp terminals or screw connectors located at one end of the relay socket, a 2-pole bus jumper may be used to simplify cabling when creating an equipotential link between terminals. The relay socket may also provide female electrical contacts for receiving the conducting terminals of the relay plug. The number of female electrical contacts may be 8 or 11 or 14.

The relay socket may also comprise a clamping or latching mechanism for releasably holding the relay plug in place when in the compatible mode. The relay socket may also comprise a protection module, which may be a diode, a RC circuit or a varistor. The relay socket may be mounted on a circuit board or on a chassis of an electrical system.

The relay socket may have dimensions of about 95 mm (length) by about 30 mm (width) by about 40 mm (height), where the length and width form a plane parallel to the surface on which the access holes or openings for accessing the electrical contacts of the socket are located. The length of the relay socket may be in a range of about 75 mm to about 105 mm, or about 79 mm to about 95 mm, or about 80 mm to about 100 mm. The width of the relay socket may be in a range of about 25 mm to about 35 mm, or about 30 mm to about 35 mm or about 25 mm to about 30 mm. The height of the relay plug may be in a range of about 40 mm to about 85 mm, or about 43 mm to about 61 mm, or about 43 mm to about 81 mm.

Where the relay socket comprises the guide on which the abutment is slidable, the guide may be elongate and positioned lengthwise with respect to the relay socket. The guide may have a length of about 60 mm and a width of about 2 mm. The length of the guide may be in the range of about 8 mm to about 65 mm, or about 18 mm to about 35 mm or about 25 mm to about 30 mm. In one embodiment, the length of the guide is less than about 80 mm.

In another embodiment, the guide is elongate and may be positioned widthwise with respect to the relay socket. The guide may have a length of about 20 mm and a width of about 2 mm. The length of the guide may be in a range of about 8 mm to about 30 mm, or about 15 mm to about 18 mm or about 10 mm to about 18 mm. In one embodiment, the length of the guide is less than about 50 mm.

Advantageously, in some implementations, there is provided the relay socket having a considerably limited surface area for accommodating the guide and the abutment.

The relay plug may further comprise a spring return push-button for testing of its relay components, a "relay status" indicator (usually in a form of an LED or of a mechanical nature), and a removable lock-down mechanism for forcing relay components to a desired state so as to conduct test sequences, for example, during maintenance. The relay plug may also comprise a rail mounting adaptor or a panel adaptor with fixing lugs to facilitate adaptive connection using blade connectors to different kinds of relay sockets.

The relay plug may have dimensions of about 27 mm (length) by about 21 mm (width) by about 40 mm (height), where the length and width form a plane parallel to the surface from which the conducting terminals extend. The length of the relay plug may be in a range of about 25 mm to about 45 mm, or about 27 mm to about 43 mm, or about 38 mm to about 43 mm. The width of the relay plug may be in a range of about 18 mm to about 25 mm, or about 20 mm to about 23 mm or about 21 mm to about 24 mm. The height of the relay plug may be in a range about 40 mm to about 65 mm, or about 48 mm to about 55 mm or about 40 mm to about 55 mm.

In an embodiment disclosed herein where the relay plug comprises the guide on which the abutment is slidable, the guide may be positioned lengthwise with respect to the relay plug. The guide may have a length of about 18 mm and a width of about 2 mm. The length of the guide may be of a range of about 8 mm to about 40 mm, or about 18 mm to about 35 mm or about 25 mm to about 30 mm. In one embodiment, the length of the guide is less than about 50 mm.

In another embodiment, the guide is positioned widthwise with respect to the relay plug. In this embodiment, the guide has a length of about 18 mm and a width of approximately 2 mm. The length of the guide may be in a range of about 8 mm to about 20 mm, or about 15 mm to about 18 mm or about 10 mm to about 18 mm. In one embodiment, the length of the guide is less than about 50 mm.

Advantageously, in some implementations, there is provided the relay plug having a considerably limited surface area for accommodating the guide and the abutment.

The abutment may have dimensions of about 1.8 mm (length) by about 5 mm (width) by about 10 mm (height). The height of the abutment may comprise the height of a portion of the abutment extending from the guide and the height of another portion of the abutment concealed by the guide. The height of the abutment may be in a range of about 5 mm to about 15 mm, or about 5 mm to about 10 mm or about 10 mm to about 15 mm. In one embodiment, the abutment has a height of less than 20 mm. The length of the abutment may be limited by the width of the guide and may be in a range of about 1.5 mm to about 1.9 mm, or about 1.5 mm to about 1.8 mm or about 1.8 mm to about 1.9 mm. In one embodiment, the abutment has a length of less than 2 mm.

In one embodiment, the abutment is of an appropriate size for the user to easily adjust the abutment along the guide.

The recess disclosed herein for receiving the abutment may have dimensions of about 1.8 mm (length) by about 5 mm (width) by about 6 mm (depth). The depth of the recess may be in a range of about 2 mm to about 10 mm, or about 2 mm to about 6 mm or about 6 mm to about 10 mm. The length of the recess may be dependent on the corresponding length of the abutment and may be in a range of about 1.4 mm to about 1.8 mm, or about 1.4 mm to about 1.7 mm or about 1.7 mm to about 1.8 mm.

In various embodiments, the recess is of an appropriate size to allow receiving of the abutment in the compatible mode and to substantially prevent receiving of the abutment in the incompatible mode.

Referring now to FIG. 1, there is shown an illustrative embodiment of a socket disclosed herein. An abutment 100 and at least one electrical contact 102 is being disposed on a same surface of a relay socket 104, in particular on a same surface of a socket housing 106 of the relay socket 104. The abutment 100 is for mating with a matching recess on a compatible plug.

The abutment 100 is electrically non-conductive. A guide 108 is be provided on the surface of the relay socket 104, in particular on the socket housing 106 to allow the abutment 100 to be positionally slidable between different modes corresponding to different voltage configuration of the socket 104. In this embodiment, the guide 108 is a substantially straight guide. The relay socket 104 has a length ($l_S$), a width ($w_S$) and a height ($h_S$).

Figure 2:
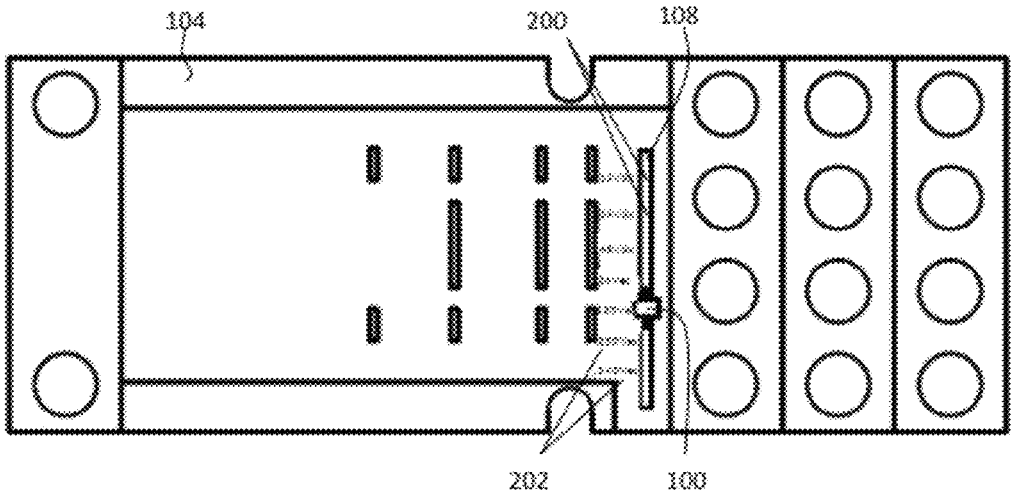
FIG. 2 shows a plan view of the socket of FIG. 1.

FIG. 2 is a plan view of the relay socket 104 of FIG. 1. The abutment 100 is positionally slidable to different predetermined positions 200 along the guide 108. The predetermined positions 200 correspond to different voltage configurations of the relay socket 104. The relay socket 104 further comprise an indicating means, in the form of labels 202 for visually indicating to a user the different predetermined positions 200 (and consequently different voltage rating configurations) at which the abutment 100 is positionable. The labels 202 are prints on the socket relay 104, reflecting the various voltage rating configurations. The prints comprise the words "12 Vdc", "24 Vdc", "48 Vdc", "24 Vac", "120 Vac", "230 Vac" and "240 Vac" at the different positions (not shown).

Figure 3A:
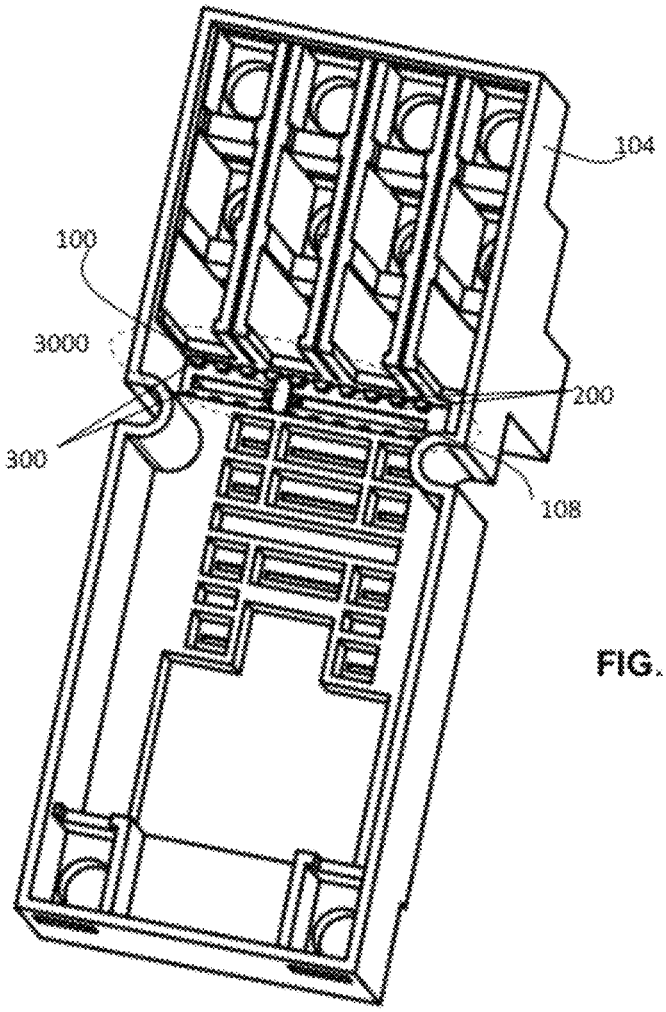
FIG. 3A shows a bottom perspective view of the socket of FIG. 1.
Figure 3B:
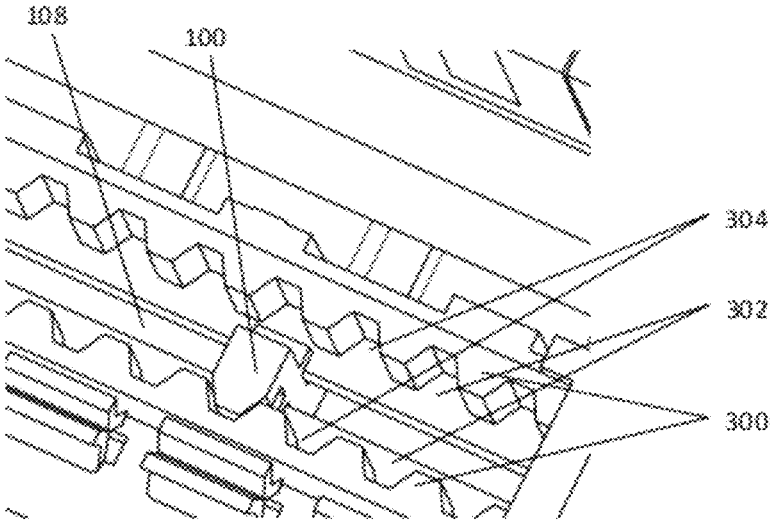
FIG. 3B shows an expanded view of an encircled area 3000 of FIG. 3A.

FIG. 3A shows a bottom view of the relay socket 104 of FIG. 1. The guide 108 is provided with a retaining means 300 for reversibly securing the abutment 100 at the predetermined positions 200. Each retaining means 300 is in the form of a pair of transverse slots 302 as illustrated in FIG. 3B, which shows the expanded view of an encircled area 3000 of FIG. 3A. Each of the transverse slots 302 comprises a tapered end. A series of transverse slots 302 is provided along the guide 108 to form a toothed structure 304 for reversibly securing the abutment 100 at the predetermined positions 200.

Figure 4A:
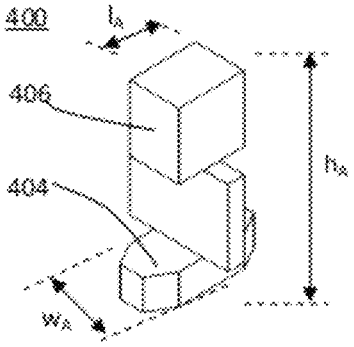
FIG. 4A shows a perspective view of an embodiment of an abutment of disclosed herein.
Figure 4B:
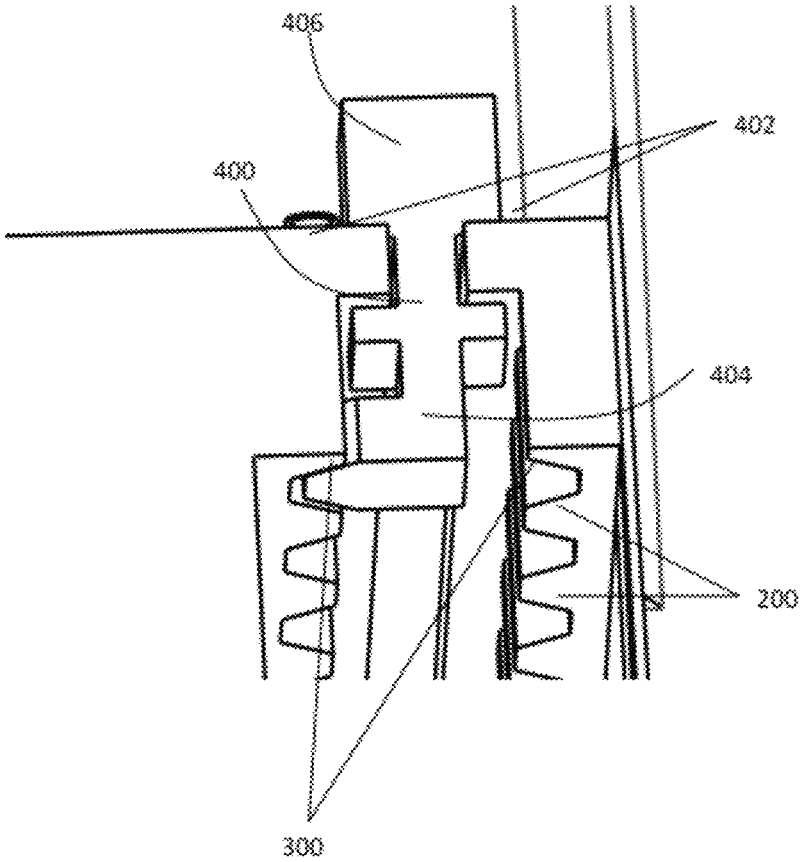
FIG. 4B shows a side view of the abutment of FIG. 4A in a socket disclosed herein.

Referring to FIG. 4A and FIG. 4B, there is shown an embodiment of the abutment disclosed herein and the abutment in a socket disclosed herein respectively. The abutment 400 is positionally slidable along a guide. The guide comprises a parallel rail guide 402. In this embodiment, the abutment 400 comprises a first flange portion 404. The retaining means 300 is for releasably engaging the first flange portion 404 of the abutment 400 at the predetermined positions 200. The abutment 400 further comprises a second flange portion 406. The first flange portion 404 and the second flange portion 406 are positioned at opposite ends of the abutment 400, as illustrated in FIG. 4A. The first flange portion 404 and the second flange portion 406 are arranged to hold the abutment 400 along the parallel rail guide 402, as seen in FIG. 4B. The abutment 400 has a length ($l_A$), a width ($w_A$) and a height ($h_A$).

Figure 5A:
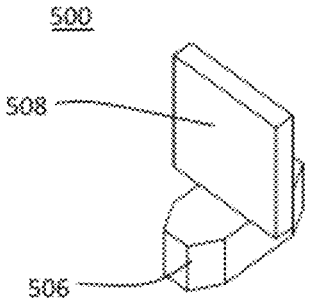
FIG. 5A shows a perspective view of another embodiment of an abutment disclosed herein.
Figure 5B:
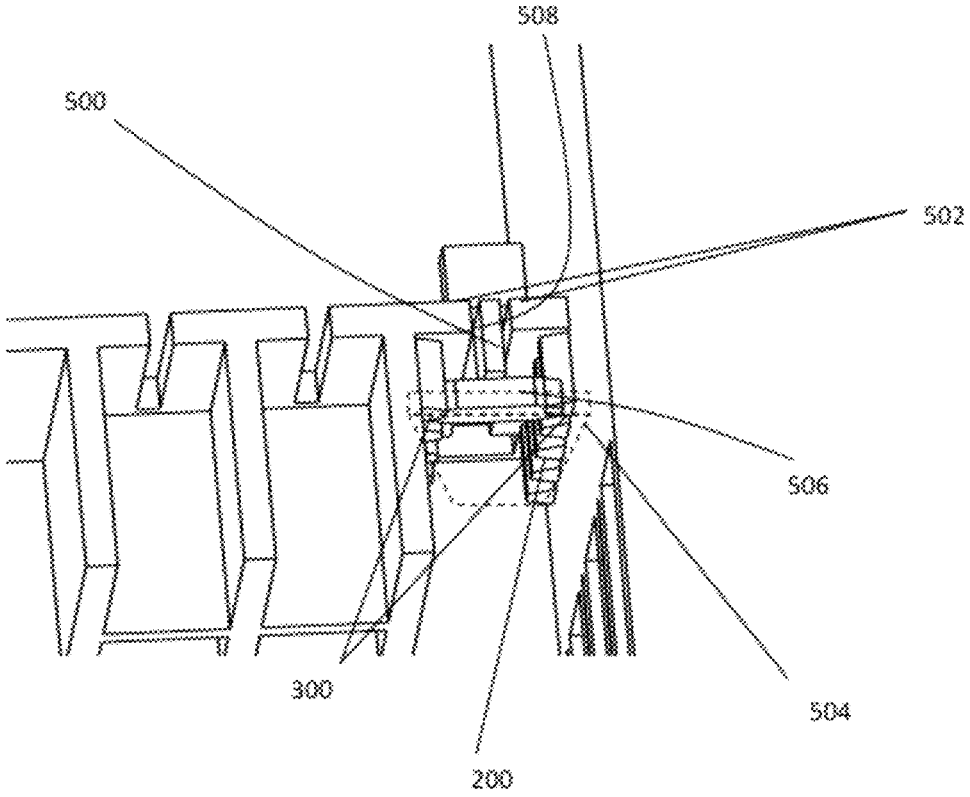
FIG. 5B shows a side view of the abutment of FIG. 5A in a socket disclosed herein.

Referring to FIG. 5A and FIG. 5B, there is shown yet another embodiment of the abutment disclosed herein and the abutment in a socket disclosed herein respectively. An abutment 500 is positionally slidable along a guide. The guide comprises a gripping rail guide 502. The gripping rail guide 502 provides a parallel rail guide, in a form of the parallel rail guide 402 of FIG. 4A and additionally an underlying support 504 (represented by dashed lines for clarity). The abutment 500 comprises a flange portion 506, as illustrated in FIG. 5A. In FIG. 5B, the retaining means 300 is for releasably engaging the flange portion 506 of the abutment 500 at the predetermined positions 200. The abutment 500 further comprises an elongate portion 508 abutting the flange portion 506. The elongate portion 508 protrudes through the gripping rail guide 502 for coupling with a matching recess of a plug-in relay in the compatible mode (not shown in FIG. 5A). The abutment 500 is also configured to slide along the gripping rail guide 502 held between the parallel rail guide and the underlying support 504.

In these embodiments, the flange portions 404, 506 of the abutments 400, 500 are made of a plastic and are releasable from the retaining means 300 at the predetermined positions 200 by exerting a force to disengage or release the flange portions 404, 506 of the abutments 400, 500 from the retaining means 300.

Figure 6:
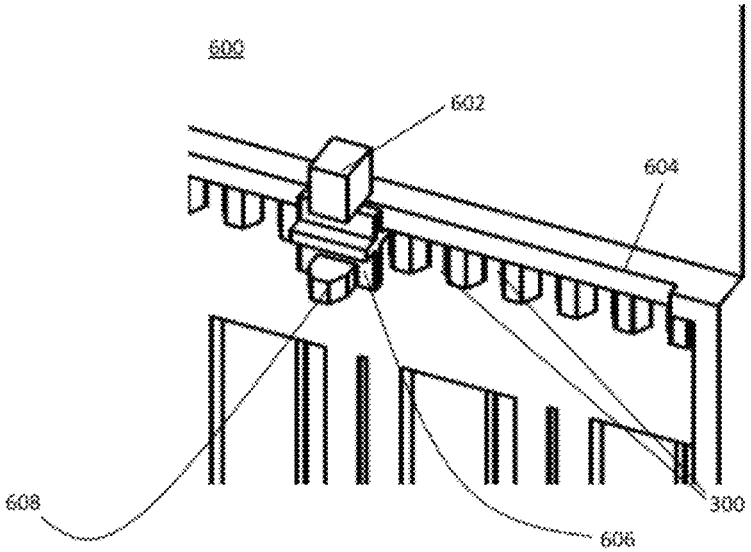
FIG. 6 shows a perspective view of yet another embodiment of an abutment in a socket disclosed herein.

FIG. 6 shows still yet another embodiment of the abutment in a socket disclosed herein. In FIG. 6, the socket 600 is shown partially at its cross-section, revealing an abutment 602 positionally slidable along a guide 604 and releasably securable to the retaining means 300. The abutment 602, comprises a different structure as compared to the abutments 400, 500 as previously described in FIGS. 4 and 5. In this embodiment, a flange portion (hidden from view) of the abutment 602 is releasably securable to the retaining means 300 and is releasable from the retaining means 300 by exerting a force to disengage or release the flange portion of the abutment 602 from the retaining means 300. The flange portion (hidden from view) comprises a hard point or a protrusion extending from a surface of an elongate portion 606 of the abutment 602. The flange portion (hidden from view) may be similar to, for example, a flange portion 608. In this embodiment, the flange portion 608 is located at an end of the elongate portion 606 of the abutment 602. In various embodiments, the flange portion may be located at a different location or part along the elongate portion of the abutment as long as the flange portion is releasably securable to the retaining means.

Figure 7A:
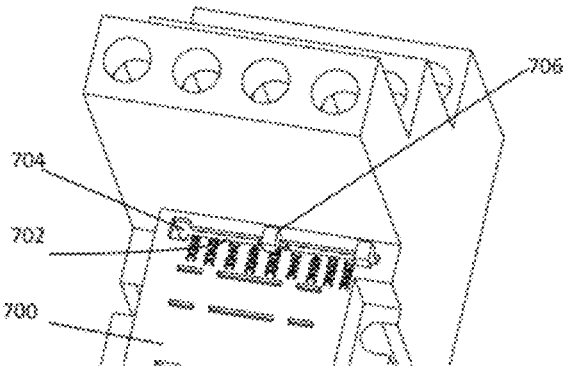
FIG. 7A shows a partial perspective view of an embodiment of the socket disclosed herein.
Figure 7B:
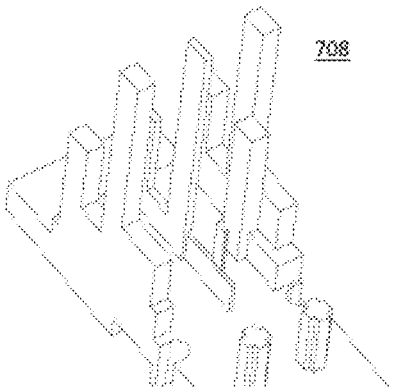
FIG. 7B shows a partial perspective view of an embodiment of an underlying stopper disclosed herein for insertion to the bottom of the socket in FIG. 7A.
Figure 7C:
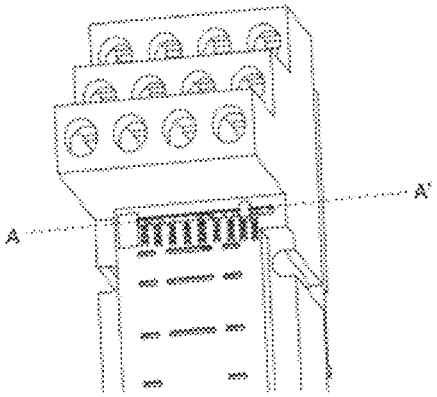
FIG. 7C shows a partial perspective view of the underlying stopper of FIG. 7B inserted the socket of FIG. 7A.
Figure 7D:
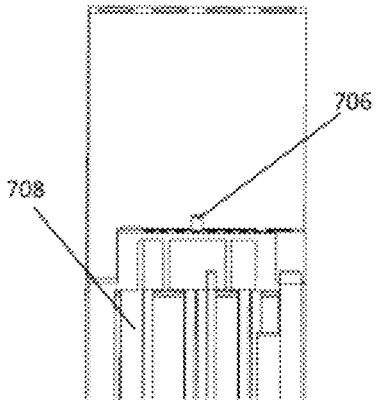
FIG. 7D shows a cross-sectional side view from line A-A' of FIG. 7C.

As illustrated in FIG. 7A, there is provided another different embodiment of a relay socket 700 disclosed herein. The relay socket 700 comprises a guide 702 having an opening 704 to allow a mating means in the form of an abutment 706 to be removed from the guide 702 or to be re-inserted into the guide 702. This way, if the abutment 706 is removed from the relay socket 700, the relay socket 700 can be coupled to a standard plug-in relay (or a plug-in relay known in the art) which does not have a corresponding matching means as disclosed herein and which are readily available. In this embodiment, if the abutment 706 is inserted or re-inserted into the guide 702, then the opening 704 can be plugged by a stopper. An embodiment of a stopper 708 is shown in FIG. 7B. FIG. 7C and FIG. 7D show the stopper 708 being inserted into the relay socket 700 to prevent the removal of the abutment 706 from the relay socket 700. The stopper 708 is made of a polymer such as plastic. In this embodiment, the stopper 708 substantially matches the inner structure of the relay socket 700 such that upon plugging, the stopper 708 provides a substantially full cover from the underneath of the relay socket 700 as in FIG. 7C and FIG. 7D.

Figure 8A:
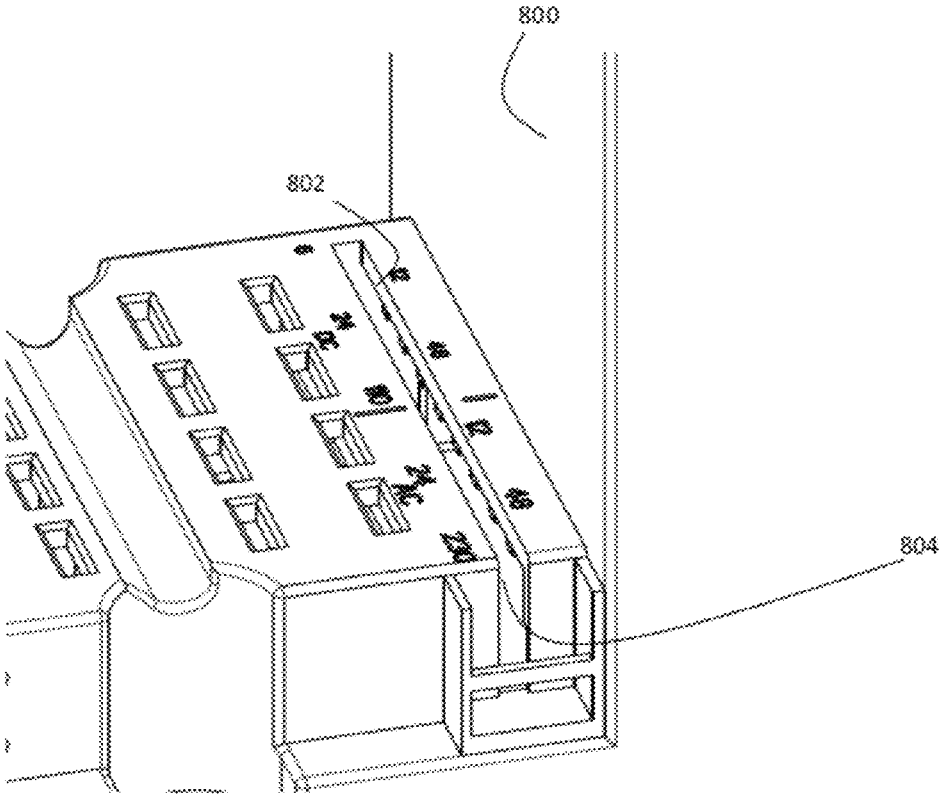
FIG. 8A shows a partial perspective view of an embodiment of the socket disclosed herein.
Figure 8B:
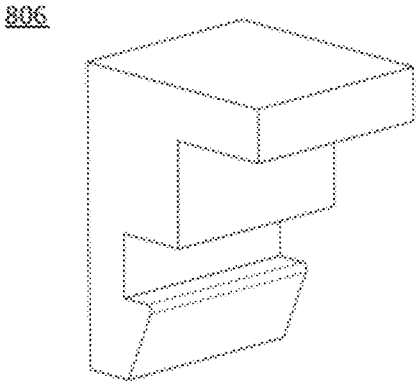
FIG. 8B shows a perspective view of an embodiment of a stopper disclosed herein for insertion to the socket in FIG. 8A.
Figure 8C:
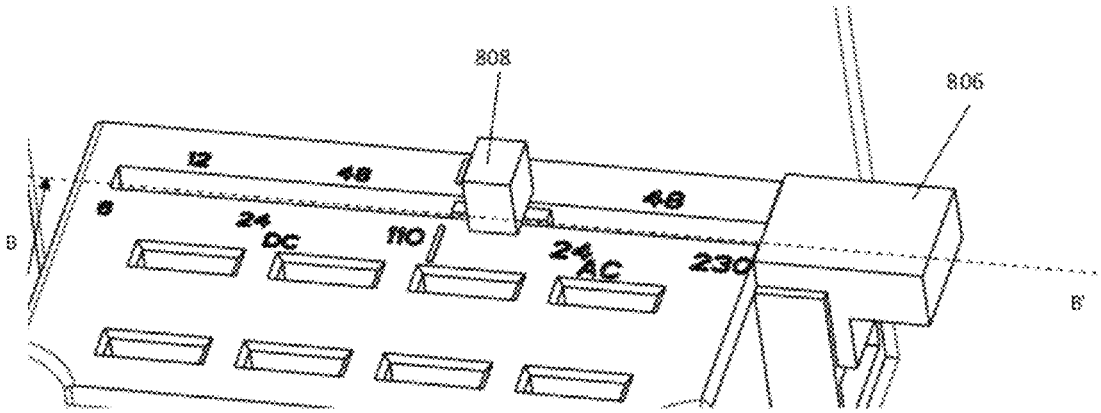
FIG. 8C shows a partial perspective view of the stopper of FIG. 8B inserted into the socket of FIG. 8A.
Figure 8D:
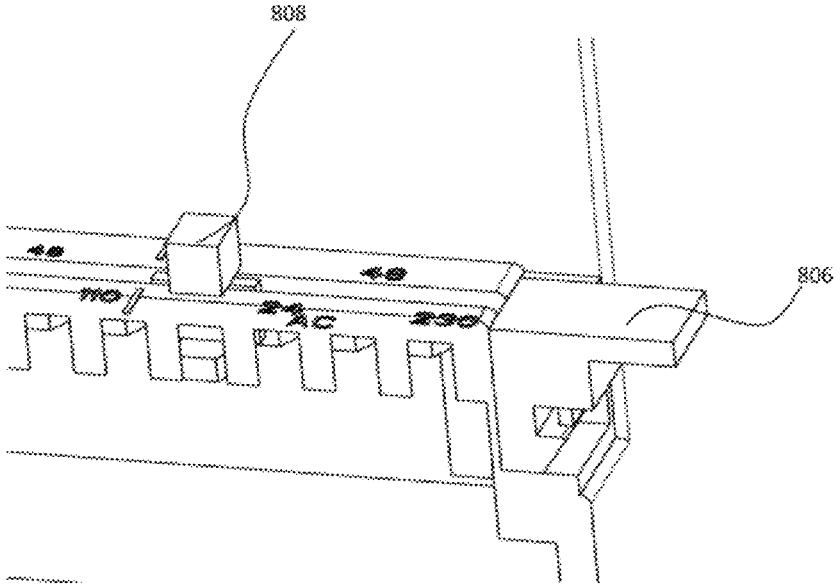
FIG. 8D shows a cross-sectional side view from line B-B' of FIG. 8C.

FIG. 8A shows yet another different embodiment of a relay socket 800 disclosed herein. The relay socket 800 comprises a guide 802 having an opening 804. A stopper 806 shown in FIG. 8B may be used to plug the opening 804 of FIG. 8A. With a mating means in the form of an abutment 808 inserted into the guide 802, the stopper 806 is be used to plug the opening 804 as shown in FIG. 8C and FIG. 8D. This way, the stopper 806 being inserted into the relay socket 800 prevents the removal of the abutment 808 from the relay socket 800. The stopper 806 is made a polymer, such as plastic.

FIG. 9A shows an embodiment of a plug-in relay 900 disclosed herein for coupling electrically to a relay socket (not shown in FIG. 9A), such as the relay sockets described in FIGS. 1 to 8. In this embodiment, the plug-in relay 900 comprises at least one conducting terminal 902 and a matching means in the form of a recess 904 on the plug-in relay 900 for mating with a corresponding mating means in the form of an abutment (for example, similar to the abutment 100, 400, 500, 600, 706, 808) disposed on the relay socket (not shown in FIG. 9A). The recess 904 is arranged on the plug-in relay 900 at a predefined position representing a particular voltage rating configuration of the plug-in relay 900. The recess 904 was introduced to the plug-in relay 900 during its manufacture. The plug-in relay 900 has a length ($l_P$), a width ($w_P$) and a height ($h_P$).

FIG. 9B shows a different embodiment of a plug-in relay 906, similarly comprising a recess 908 for mating with the mating means in the form of an abutment (for example, similar to the abutment 100, 400, 500, 600, 706, 808) disposed on the relay socket (not shown in FIG. 9B). The recess 908 is located at a different predefined position from the recess 904 of FIG. 9A; therefore the plug-in relay 900 of FIG. 9A is of a different voltage rating configuration from the plug-in relay 906 of FIG. 9B. The recess 908 has a length ($l_R$), a width ($w_R$) and a height ($h_R$), as seen in an expanded view (FIG. 9C) of an encircled area 9000.

Figure 10:
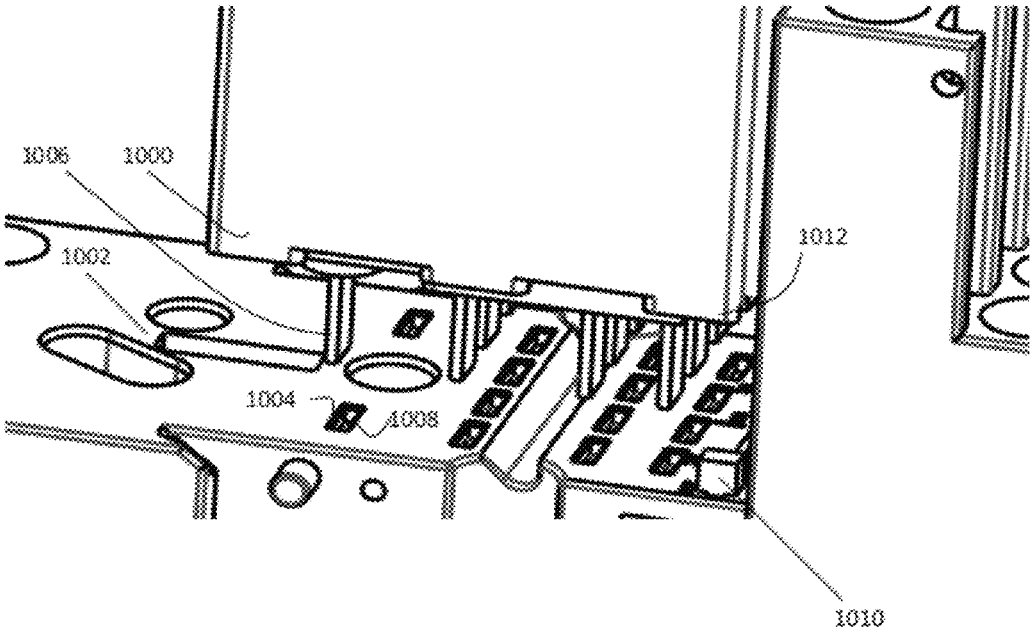
FIG. 10 shows a perspective view of an embodiment of the a relay and socket assembly disclosed herein.

FIG. 10 shows an embodiment of a plug-in relay 1000 and a relay socket 1002 assembly disclosed herein. In FIG. 10, at least one electrical contact 1004 of the relay socket 1002 is for coupling to at least one conducting terminal 1006 of the plug-in relay 1000. The at least one electrical contact 1004 is located in a cavity 1008 of the relay socket 1002, the cavity 1008 is suitably sized and shaped for receiving the at least one conducting terminal 1006. The relay socket 1002 comprises a mating means in the form of an abutment 1010 disposed on the relay socket 1002, the abutment 1010 is for mating with a matching means in the form of a recess 1012 on the plug-in relay 1000. The abutment 1010 is configured to be adjustable between at least two different modes, at least one mode is a compatible mode and at least one mode is an incompatible mode. When in the compatible mode, the abutment 1010 allows the electrical contact 1004 to contact the conducting terminal 1006, and when in the incompatible mode, the abutment 1010 substantially prevents the electrical contact 1004 from contacting the conducting terminal 1006. The different modes correspond to different voltage rating configurations of the socket 1002. This measure can allow the user to couple the correct plug-in relay 1000 having the matching voltage rating configuration to the relay socket 1002.

Figure 11:
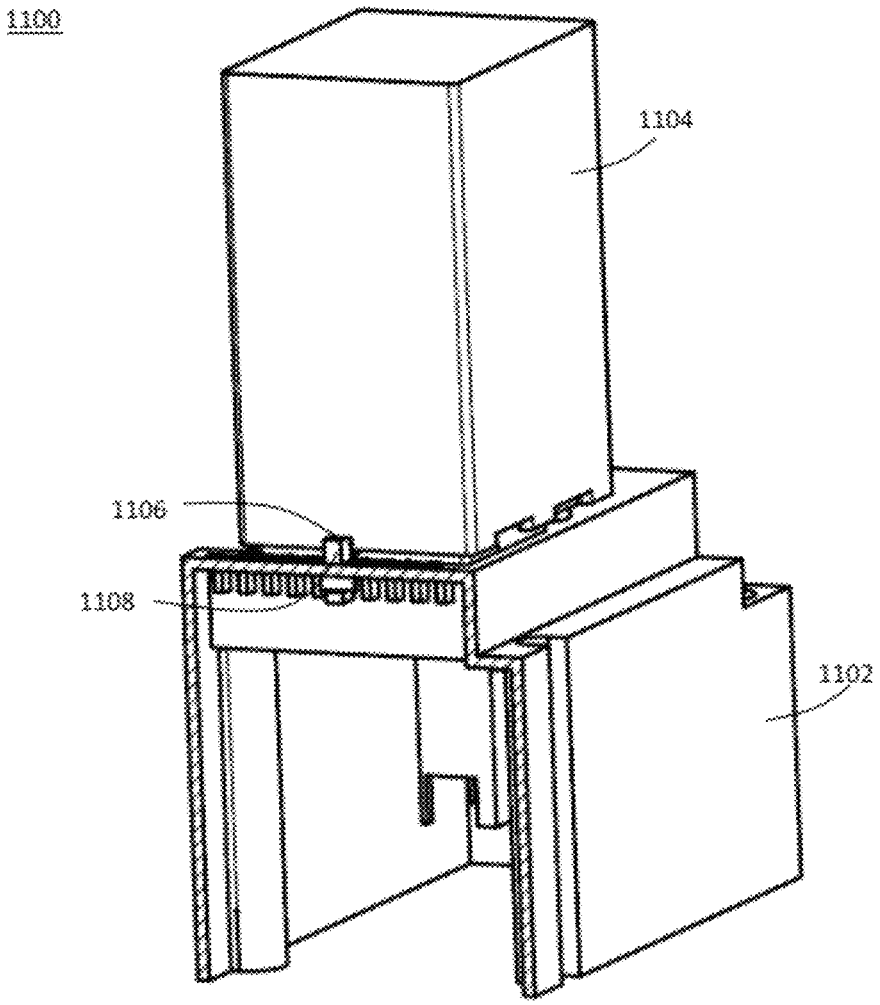
FIG. 11 shows a cross-sectional perspective view of an embodiment of a socket and plug assembly in the compatible mode disclosed herein.

FIG. 11 shows in an embodiment (in cross-sectional view) of an assembly 1100 of a relay socket 1102 and a plug-in relay 1104 in a compatible mode. In this compatible mode, a predefined position of a matching means in the form of a recess 1106 is disposed on the plug-in relay 1104, and represents a particular voltage rating configuration of the plug-in relay 1104. In the compatible mode, the recess 1106 is substantially aligned with a mating means in the form of an abutment 1108 of the relay socket 1102 at a predetermined position representing the same voltage rating configuration. The abutment 1108 is adjustable to this predetermined position by a user to provide the compatible mode and also adjustable to a different predetermined position by the user to provide the incompatible mode.

When in use in the compatible mode, the voltage rating configuration of the relay socket 1102 matches or is compatible to the voltage rating configuration of the plug-in relay 1104. In the compatible mode, plural electrical contacts of the relay socket 1102 is electrically coupled to plural conducting terminals of the plug-in relay 1104 to establish electrical connections therebetween.

If the user adjusts the abutment 1108 of the relay socket 1102 to a predetermined position to represent a selected voltage rating configuration, for example, 12 Vdc, then only the plug-in relay 1104 with the voltage rating configuration of 12 Vdc comprising the corresponding recess 1106, which is located at a predefined position for 12 Vdc, will be substantially in alignment with the mating means 1108, and the plug-in relay 1104 with the voltage rating configuration of 12 Vdc is then allowed to be electrically coupled to the relay socket 1102 when in use.

If the user adjusts the abutment 1108 of the relay socket 1102 to a different predetermined position, for example representing a voltage rating configuration of 48 Vdc, the plug-in relay 1104 with the voltage rating configuration of 12 Vdc comprising a recess 1106, which is located at a predefined position for 12 Vdc, will be misaligned to the abutment 1108, and thus due to physical impediment, the plug-in relay 1104 with the voltage rating configuration of 12 Vdc is not allowed to be electrically coupled to the relay socket 1102.

The incompatible mode comprises at least two different predetermined positions at which the abutment 1108 is positionable, that is, at least two other voltage rating configuration other than for example 12 Vdc.

As may be appreciated in view of the foregoing disclosure, the presently disclosed embodiments of a socket, a plug, and a plug and socket assembly provide a simple yet effective measure of allowing the matching of a plug of a specific voltage rating configuration to a socket of the same voltage rating configuration. The socket, plug, and plug and socket assembly can be used as a relay socket, relay plug, and relay plug and relay socket assembly. Advantageously, users can easily, quickly and accurately identify the matching relay plug for the specific socket. Consequently, the possibility of relay plug and socket mismatch is significantly reduced, thereby also reducing the likelihood of circuit malfunction or overloading. Advantageously, the socket disclosed herein can also be used with existing plugs known in the art. Similarly, the plug disclosed herein can also be used with existing sockets known in the art. The versatility of the socket and plugs disclosed herein provides users a favorable alternative to existing plugs and sockets.

It will be understood, however, that the present invention may be practiced without necessarily providing one or more of the advantages described herein or otherwise understood in view of the disclosure and/or that may be realized in some embodiments thereof. Additionally, it will be appreciated by a person skilled in the art that numerous variations and/or modifications may be made to the specific embodiments disclosed herein without departing from the spirit or scope of the invention as broadly described. The presently disclosed embodiments are, therefore, to be considered in all respects to be illustrative and not restrictive. It is, therefore, intended that the present invention is not limited to the disclosed embodiments but should be defined in accordance with the claims that follow.

What is claimed is:

1. A socket for coupling electrically to a plug, the socket comprising:

a mating means disposed on the socket for mating with a matching means on a first plug, said mating means configured to be adjustable between a compatible mode and an incompatible mode; and an electrical contact on the socket for coupling electrically to a conducting terminal of the first plug;

wherein when in the compatible mode, the mating means is configured to mate with the matching means of the first plug to allow the electrical contact to contact the conducting terminal of the first plug, and when in the incompatible mode, the mating means is configured to not mate with the matching means of the first plug such that the mating means substantially prevents the electrical contact from contacting the conducting terminal of the first plug; and wherein the incompatible mode comprises at least one configuration of the mating means such that for each of the at least one incompatible mode configurations of the mating means, the mating means (i) is configured to allow electrical coupling between the electrical contact of the socket and a given conducting terminal of a given plug in the event that the given plug has a given matching means that corresponds to the incompatible mode configuration of the mating means such that the given matching means is configured to mate with the mating means, and (ii) prevents electrical coupling between the electrical contact of the socket and the given conducting terminal of the given plug in the event that the given plug does not have the given matching means that corresponds to the incompatible mode configuration of the mating means.

2. The socket as claimed in claim 1, wherein the mating means and the electrical contact are disposed on a same surface of the socket.

3. The socket as claimed in claim 1, wherein (i) the mating means comprises an abutment and the matching means comprises a recess and/or (ii) the mating means comprises a recess and the matching means comprises an abutment.

4. The socket as claimed in claim 3, wherein the abutment is electrically non-conductive.

5. The socket as claimed in claim 3, wherein the abutment is positionally slidable between the compatible mode and the incompatible mode.

6. The socket as claimed in claim 5, wherein the abutment is reversibly securable at predetermined positions.

7. The socket as claimed in claim 1, wherein the mating means comprises a recess and the matching means comprises an abutment, and the mating means is reversibly sealable to be positionable in the compatible mode or in the incompatible mode.

8. The socket as claimed in claim 1, wherein the conducting terminal of the first plug and the given conducting terminal of the given plug each comprises a plurality of conducting terminals, and wherein the electrical contact on the socket comprises a plurality of electrical contacts on the socket for electrically coupling (i) to the plurality of conducting terminals of the first plug to establish electrical connections therebetween when in the compatible mode, or (ii) to the plurality of conducting terminals of the given plug to establish electrical connections therebetween when in the incompatible mode and in the event that the given plug has a given matching means that corresponds to the incompatible mode configuration of the mating means.

9. The socket as claimed in claim 1, wherein the socket is a relay socket.

10. The socket as claimed in claim 1, wherein each of the first plug and the given plug is a relay plug.

11. The socket as claimed in claim 1, wherein when in use in the compatible mode, a voltage rating configuration of the socket matches or is compatible to a voltage rating configuration of the first plug, and wherein when in use in the incompatible mode in the event that the given plug has a given matching means that corresponds to the incompatible mode configuration of the mating means, the voltage rating configuration of the socket matches or is compatible to a given voltage rating configuration of the given plug.

12. The socket as claimed in claim 5, wherein the abutment is slidable on a guide disposed on the surface of the socket.

13. The socket as claimed in claim 12, wherein the guide comprises a retaining means for reversibly securing the abutment at at least one of a plurality of predetermined positions.

14. The socket as claimed in claim 13, wherein the abutment comprises a flange portion; and wherein the retaining means comprises a slot for releasably engaging the flange portion of the abutment at the at least one of the predetermined positions.

15. The socket as claimed in any one of claim 6, wherein the incompatible mode comprises at least two different predetermined positions at which the mating means is positionable and corresponding to respective ones of the at least one incompatible mode configurations of the mating means.

16. The socket as claimed in claim 15, further comprising an indicating means for visually indicating to a user the different predetermined positions at which the mating means is positionable.

17. The socket as claimed in claim 1, wherein the mating means is disposed on a socket housing of the socket.

18. A socket housing for a socket as claimed in claim 1, wherein the socket housing comprises the mating means disposed thereron.

19. A plug for coupling electrically to a socket, the plug comprising:

a matching means on the plug for mating with a mating means disposed on a first socket; and a conducting terminal for coupling electrically to an electrical contact on the first socket;

wherein when in the compatible mode, the matching means is configured to mate with the mating means of the first socket to allow the electrical contact to contact the conducting terminal, and when in the incompatible mode, the matching means is configured to not mate with the mating means of the first socket such that the matching means substantially prevents the electrical contact from contacting the conducting terminal; and wherein the incompatible mode comprises at least one configuration of the matching means such that for each of the at least one incompatible mode configurations of the matching means, the matching means (i) is configured to allow electrical coupling between the conducting terminal of the plug and a given electrical contact of a given socket in the event that the given socket has a given mating means that corresponds to the incompatible mode configuration of the matching means such that the given mating means is configured to mate with the matching means, and (ii) prevents electrical coupling between the conducting terminal of the plug and the given electrical contact of the given socket in the event that the given socket does not have the given mating means that corresponds to the incompatible mode configuration of the matching means.

20. A plug and socket assembly comprising:

a socket comprising a mating means disposed thereon, said mating means configured to be adjustable between a compatible mode and an incompatible mode; and an electrical contact on the socket; and a first plug comprising a matching means for mating with the mating means disposed on the socket; and a conducting terminal for coupling electrically to the electrical contact on the socket;

wherein when in the compatible mode, the mating means is configured to mate with the matching means of the first plug to allow the electrical contact to contact the conducting terminal of the first plug, and when in the incompatible mode, the mating means is configured to not mate with the matching means of the first plug such that the mating means substantially prevents the electrical contact from contacting the conducting terminal of the first plug; and wherein the incompatible mode comprises at least one configuration of the mating means such that for each of the at least one incompatible mode configurations of the mating means, the mating means (i) is configured to allow electrical coupling between the electrical contact of the socket and a given conducting terminal of a given plug in the event that the given plug has a given matching means that corresponds to the incompatible mode configuration of the mating means such that the given matching means is configured to mate with the mating means, and (ii) prevents electrical coupling between the electrical contact of the socket and the given conducting terminal of the given plug in the event that the given plug does not have the given matching means that corresponds to the incompatible mode configuration of the mating means.

21. A plug and socket assembly comprising:

a first socket comprising a mating means disposed thereon; and an electrical contact on the first socket, and a plug comprising a matching means for mating with the mating means disposed on the first socket, said matching means configured to be adjustable between a compatible mode and an incompatible mode; and a conducting terminal for coupling electrically to the electrical contact on the first socket, wherein when in the compatible mode, the matching means is configured to mate with the mating means of the first socket to allow the electrical contact to contact the conducting terminal, and when in the incompatible mode, the matching means is configured to not mate with the mating means of the first socket such that the matching means substantially prevents the electrical contact from contacting the conducting terminal; and wherein the incompatible mode comprises at least one configuration of the matching means such that for each of the at least one incompatible mode configurations of the matching means, the matching means (i) is configured to allow electrical coupling between the conducting terminal of the plug and a given electrical contact of a given socket in the event that the given socket has a given mating means that corresponds to the incompatible mode configuration of the matching means such that the given mating means is configured to mate with the matching means, and (ii) prevents electrical coupling between the conducting terminal of the plug and the given electrical contact of the given socket in the event that the given socket does not have the given mating means that corresponds to the incompatible mode configuration of the matching means.

22. A plug and socket assembly comprising at least one of a socket as claimed in claim 1, and a plug as claimed in claim 19 for coupling to the socket.

23. The plug and socket assembly of claim 22, wherein the plug and socket assembly is a relay plug and relay socket assembly.

* * * * *